US007438036B2

(12) United States Patent
Hesher et al.

(10) Patent No.: US 7,438,036 B2
(45) Date of Patent: Oct. 21, 2008

(54) OIL METERING VALVE SEAL

(75) Inventors: Eric W. Hesher, Avilla, IN (US); Robert W. Lehmann, Fort Wayne, IN (US)

(73) Assignee: Dana Automotive Systems Group, LLC, Toledo, OH (US)

( * ) Notice: Subject to any disclaimer, the term of this patent is extended or adjusted under 35 U.S.C. 154(b) by 57 days.

(21) Appl. No.: 11/050,119

(22) Filed: Feb. 3, 2005

(65) Prior Publication Data

US 2006/0169942 A1 Aug. 3, 2006

(51) Int. Cl.
*F01M 9/10* (2006.01)

(52) U.S. Cl. ..... 123/90.37; 123/188.6; 123/188.9; 251/214; 277/502

(58) Field of Classification Search ..... 251/214; 277/502, 503; 123/188.6, 188.9, 90.37
See application file for complete search history.

(56) References Cited

U.S. PATENT DOCUMENTS 1,868,668 A 7/1932 Mahon
2,860,615 A 11/1958 Mayes
4,124,220 A * 11/1978 Leone et al. ..... 277/502
4,125,265 A 11/1978 Grzesiak
4,198,062 A 4/1980 Grzesiak
4,325,558 A * 4/1982 Poggio ..... 277/502
4,915,069 A 4/1990 Lafever et al.
4,993,379 A * 2/1991 Viazzi ..... 277/502
5,058,541 A * 10/1991 Shibata et al. ..... 123/90.37
5,237,971 A 8/1993 Worsley
5,553,869 A * 9/1996 Stamback ..... 277/502
5,558,056 A * 9/1996 Sakata ..... 123/188.6
6,006,778 A * 12/1999 Kim ..... 277/502
6,209,504 B1 * 4/2001 Hegemier et al. ..... 123/188.6
6,394,463 B1 5/2002 Otani
6,412,467 B1 * 7/2002 Leimer ..... 123/188.6
6,938,877 B2 * 9/2005 McArthy et al. ..... 251/214

* cited by examiner

*Primary Examiner*—John Bastianelli
(74) *Attorney, Agent, or Firm*—Marshall & Melhorn LLC

(57) ABSTRACT

A valve stem seal having an annular valve body with an upper surface, a lower surface, and defining an aperture is disclosed. The valve body is positioned for selective sealing engagement with a valve stem. At least one orifice is disposed on an inner surface of the annular valve body between the annular valve body and the valve stem. The orifice controls the rate of oil flow between the annular valve body and the valve stem.

18 Claims, 3 Drawing Sheets

OIL METERING VALVE SEAL

FIELD OF THE INVENTION

The present invention relates to an innovative valve seal, specifically a valve stem seal for controlling oil flow between a valve stem and a valve guide of an internal combustion engine. More particularly, this invention relates to a mechanism for enhancing the control or metering of oil flow where at least a portion of a stem engaging surface of the seal includes an orifice.

BACKGROUND

Every internal combustion engine includes at least one intake valve to permit the air/fuel mixture to enter the cylinder and at least one exhaust valve to allow the burned exhaust gases to escape. The intake and exhaust valves, along with a cylinder head gasket, must also seal a combustion chamber.

Conventional internal combustion engines have a plurality of intake and exhaust valves, generally in a one-to-one relationship. Each valve comprises a head and an integral stem reciprocally mounted in a valve guide. Those skilled in the art will appreciate that there must be some oil flow along the stem in order to lubricate the latter as it reciprocates within the guide. As wear occurs in the valve guide and valve stem interface, oil flow will increase, causing excessive oil consumption and the formation of carbon deposits within the combustion chamber.

In order to reduce oil consumption and prevent carbon deposits, as well as to maintain engine performance, various designs have been developed to control or meter the oil flow between the stem and guide members. To the extent that relatively severe operating conditions occur in the exhaust and intake valve areas, much effort has been directed to geometries of valve sealing media.

In short, it is desirable to develop a method and a geometry that enhances the metering of oil between the valve stem and the valve guide, reduces manufacturing effort, and is easy to install.

BRIEF SUMMARY

The embodiments described herein illustrate a valve stem seal having an annular valve body with an upper surface, a lower surface, and defining an aperture. The valve body is positioned for selective sealing engagement with a valve stem. At least one orifice is disposed on an inner surface of the annular valve body between the annular valve body and the valve stem. The orifice controls the rate of oil flow between the annular valve body and the valve stem.

Various aspects and advantages of this invention will become apparent to those skilled in the art from the following detailed description of the embodiments described herein, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints that will vary from one implementation to another. Moreover, it will be appreciated that such a development effort might be complex and time-consuming, but would nevertheless be a routine undertaking for those of ordinary skill in the art having the benefit of this disclosure.

Figure 1:
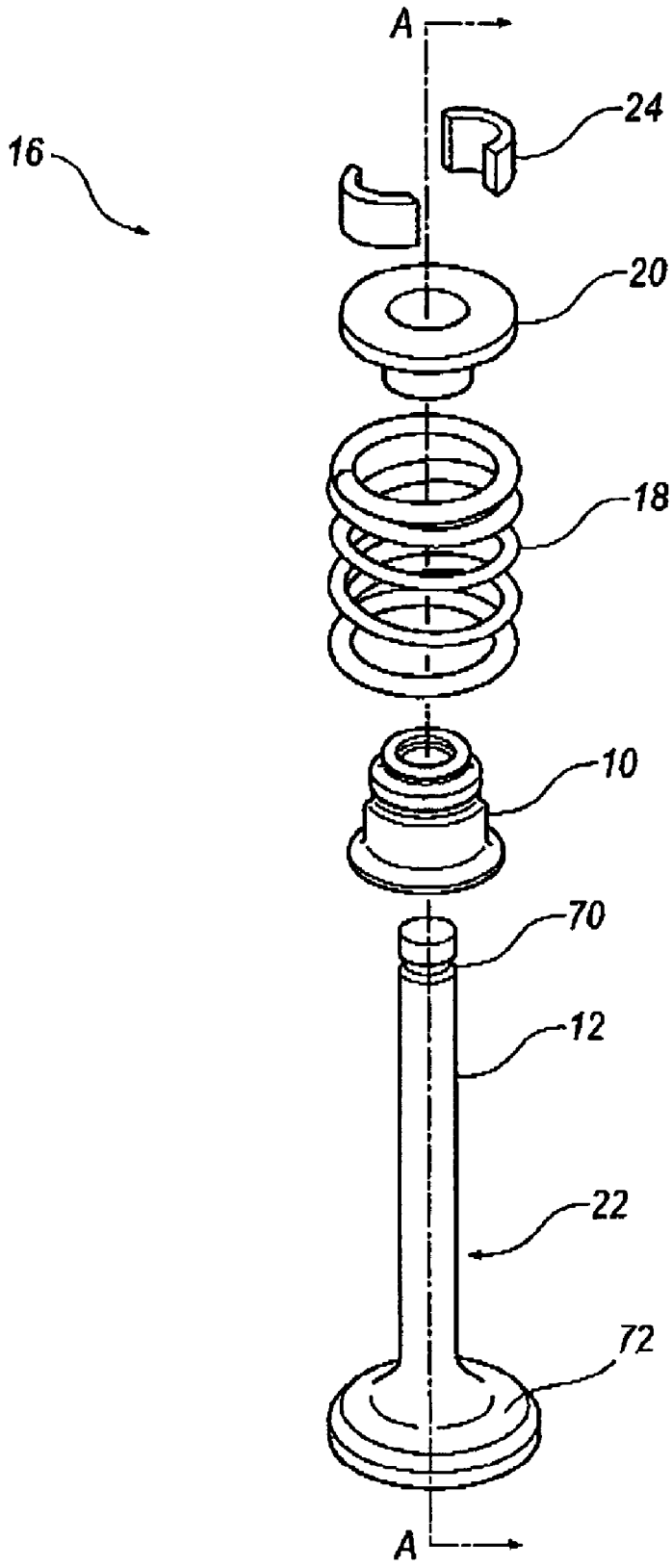
FIG. 1 is a perspective exploded view of a valve stem assembly according to an embodiment of the invention.
Figure 2:
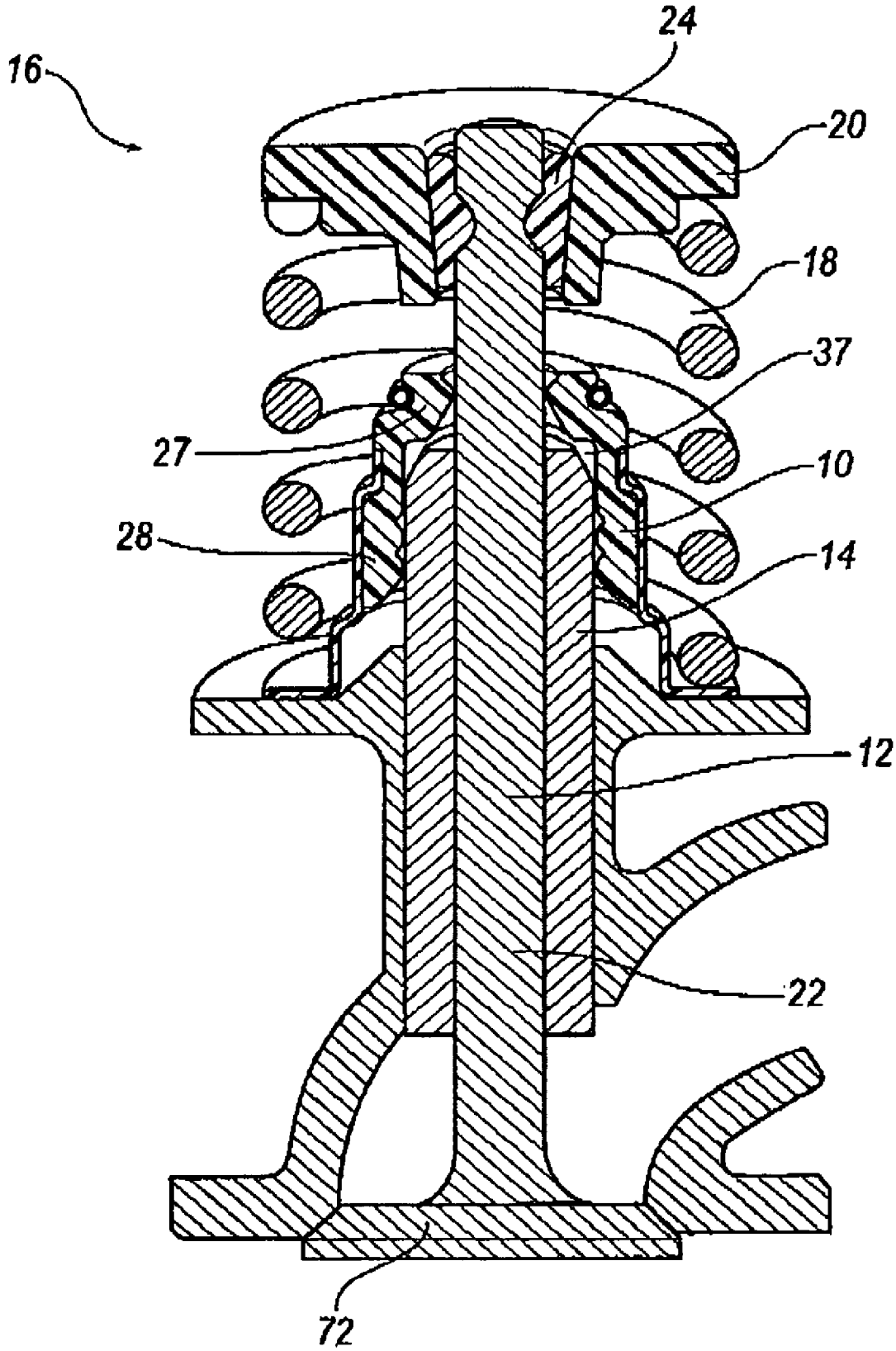
FIG. 2 is a side section view along section A-A in FIG. 1 showing the valve assembly and part of an internal combustion engine, the valve assembly is shown in a closed position.

Referring initially to FIG. 1, the valve seal 10 shown in one embodiment of the invention incorporates a simple geometry controlled by size and shape, which enhances the metering of oil between a valve stem 12 and a valve guide 14 as shown in FIG. 2. The invention is particularly suitable for intake and exhaust seal applications in internal combustion engines. The advantage of the illustrated valve seal 10 includes a higher level of oil metering precision and predictability for targeting a specific oil metering rate as further described below.

A valve stem assembly 16 as shown in FIG. 1 includes the valve seal 10, a valve spring 18, a valve retainer 20, and a valve 22. Before the spring 18 and the retainer 20 fit into place, the seal 10 is placed over the valve stem 12. The seal 10 engages the valve stem 12 to keep an undesired flow of oil from running down the valve stem 12 into a combustion chamber (not shown). The spring 18, which keeps the valve 10 in a normally closed position as shown in FIG. 2, is held in place by the retainer 20. The retainer 20 is secured to the valve stem 12 with two wedge-shaped valve keepers 24. The valve stem assembly 16 is of a type generally well known in the art of internal combustion engines.

Figure 3:
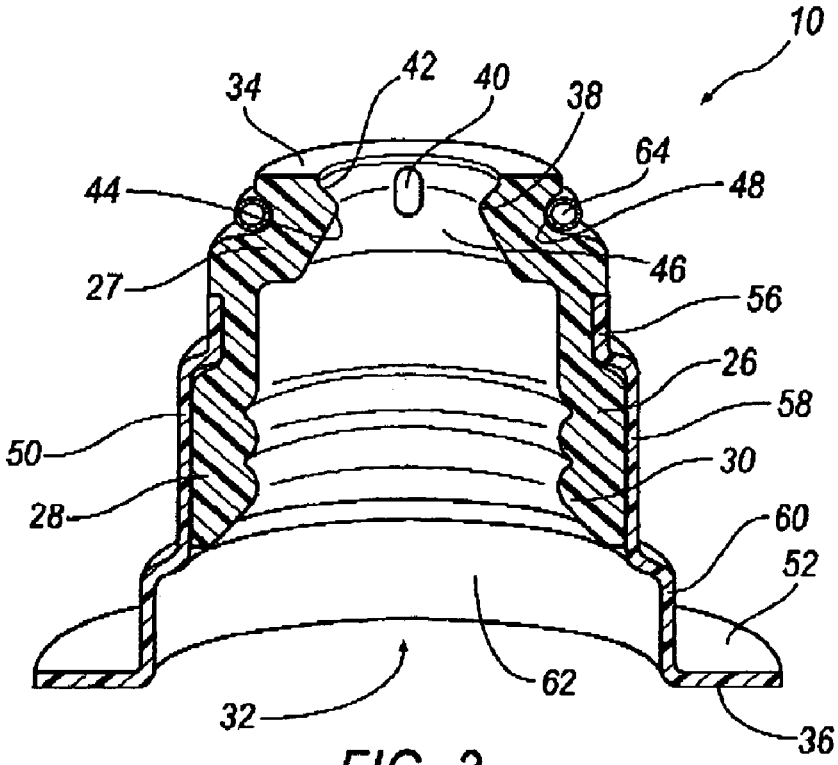
FIG. 3 a side section view along section A-A in FIG. 1 showing the valve seal.
Figure 4:
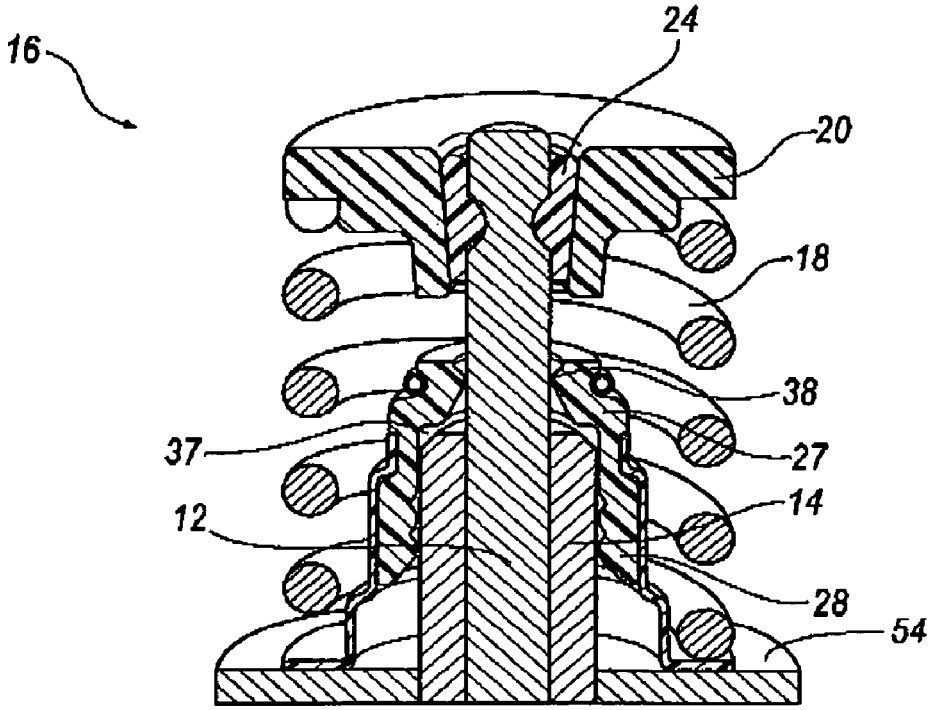
FIG. 4 is an enlarged side section view along section A-A in FIG. 1 showing the valve assembly secured to a top surface of an internal combustion engine.

The valve seal 10, as illustrated in FIG. 3, shows one embodiment of the invention defining an annular seal body 26 formed of a resilient, temperature resistant material. The seal body 26 includes an upper portion 27 and a lower portion 28, which snugly engages the valve guide 14 as shown in FIG. 4. The seal body 26 further includes a through passageway or aperture 32 disposed between an upper surface 34 and a lower surface 36 and is adapted for receiving the valve stem 12, which reciprocates under a continuously engaging contact with the upper portion 27 of the seal body 26 as shown in FIG. 2.

The valve seal 10 provides a "positive valve seal", that is a seal with actual physical contact with both valve stem 12 and valve guide 14, necessary to truly seal the combustion chamber (not shown) in a valve stem area 37 as shown in FIG. 2.

Referring to FIG. 4, an embodiment of the invention includes the upper portion 27 of the seal body 26 incorporating at least one annular upper lip 38 that is in sealing engagement with the valve stem 12. The annular upper lip 38 includes at least one orifice 40. The orifice 40 meters the oil flow along the valve stem 12 based on a predetermined shape and size. It is contemplated that the shape and size of the orifice vary in relation to a user's requirements. These requirements may vary by environmental and business considerations. The shape and dimension of the orifice 40 includes any size cross section sufficient to move oil along a length of the orifice 40.

In accordance with one aspect of the invention, orifice 40 is disposed between a first surface 42 and a second surface 44 of the inner surface 46 as illustrated in FIG. 3. The orifice 40 extends longitudinally in a generally parallel orientation with the valve stem 18, however, it is contemplated that the orifice 40 may include any path between the first surface 42 and the second surface 44. The orifice 40 provides positive flow of oil between the first surface 42 and the second surface 44, which enhances the controllability or metering of oil flow between the valve guide 30 and the valve stem 18. This is particularly critical under exhaust sealing conditions.

The upper portion 26 further includes a peripheral annular groove 48 encircling the upper portion 26 of the seal body 24 and a ring retainer 50 selectively disposed within the groove 48. Ring retainer 50 serves to compress the upper portion 26 about the reciprocating valve stem 18. The lower portion 28 of the seal body 24 includes at least one lower lip 48 in sealing circumferential engagement with the valve guide 30.

In one embodiment of the invention as shown in FIG. 3, a securement portion 50 encircles the lower portion 28 and provides additional strength and rigidity to the seal body 24. The securement portion 50 may be formed from steel, aluminum, polyamide resin, or any heat resistant material. The securement portion 50 may encircle any portion of the valve body 54 as required by the user. The illustrated embodiment shows a securement member 50 that secures the seal body 24 against the valve guide 30 and minimizes the upward and downward reciprocal movement from the valve stem 18.

The lower surface 36 of the securement portion 50 includes an outwardly extending flange 52 adapted to be in operational communication with both the engine surface 54 (shown in FIG. 4) and spring 18. The spring 18 moves the flange 52 in a downward direction against the engine surface 52 providing a biasing force at the valve retainer 20 in an upward direction. The biasing force in an upward direction biases the valve upward into a closed orientation as stated above and shown in FIG. 2.

An embodiment of an attachment method for the securement member 50 to the valve body 26 is illustrated in FIG. 3. The securement member 50 includes a plurality of depending surfaces. A first surface 56, a second surface 58, a third surface 60, and the flange 52 define a securement portion body 62. The securement portion body 62 is adapted to mate with the valve seal body 26 providing securement and additional structural integrity for the seal body 26. Other methods of securing the valve seal are contemplated including completely enclosing the valve seal body 26 (not shown) and providing attachment features (not shown) on the seal body 26 for securing the securement portion thereto.

The valve seal 10 illustrated in FIG. 2 takes advantage of the vacuum forces acting upon the valve head 56 of the valve 22 and the mist or spray effect that the rapidly reciprocating spring 18, rocker arms (not shown), and pushrods (not shown) have on the oil flow in the valve chamber (not shown). An additional benefit gained by using a "positive" valve seal 10 providing controlling or metering oil as illustrated, is elimination of vacuum loss. The fuel mixture is more stable and can be controlled to a greater degree providing more power, better gas mileage, and eliminating spark knock caused by carbon deposits from excess oil coming down the valve stem 12. In addition, the embodiments shown herein, greatly help in the reduction of hydrocarbons, which is necessary under new government restrictions on air pollution by eliminating vacuum leaks and fuel contamination by excess oil.

A method for metering oil in a valve stem assembly 16 is contemplated comprising the steps of providing a valve 22 having an annular valve stem 12, a valve keeper groove 70 at a first end, and a valve head 72 at a second end; placing a valve stem seal 10 around the valve 22, the valve stem seal 10 having an annular valve body 26 including an upper surface 34, a lower surface 36, and defining an aperture 32, the valve body 26 being in selective sealing engagement with the valve stem 12; and controlling the flow of an oil along the valve stem 12 by proving at least one orifice 40 on an inside surface 46 of the valve stem seal 10 between the annular valve body 26 and the valve stem 12. The step of controlling the flow of the oil includes placing at least one lip 38 in sealing engagement with the valve stem 12. The step of controlling the flow of the oil may also include selectively providing the orifice 40 of a shape and a size in relationship to flow requirements by a user.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A valve stem seal comprising:

an annular valve body defined by an upper surface and a lower surface, and further including an aperture extending between said upper and lower surface;

an uppermost lip of said valve body formed from a first angled upper surface and a second angled lower surface, said upper and said lower surfaces both inwardly depending to provide a single surface of said lip in selective sealing engagement with a valve stem;

at least one orifice disposed through an inner surface of said uppermost lip between said annular valve body and said valve stem, said orifice adapted to control a rate of oil flow between said annular valve body and said valve stem; and a securement portion beginning below said uppermost lip and extending below a lowermost lip.

2. The valve stem seal of claim 1, wherein said annular valve body comprises a unitary, molded, elastomeric material.

3. The valve stem seal of claim 1, wherein said orifice is disposed on said uppermost lip and includes an opening on said upper surface and said lower surface.

4. The valve stem seal of claim 1, wherein said orifice is oriented generally parallel to said valve stem.

5. The valve stem seal of claim 1, wherein said orifice includes a generally round, oval, or polygonal shape.

6. The valve stem seal of claim 1, wherein said securement portion secures said valve body from generally moving in an upward and downward direction.

7. The valve stem seal of claim 6, wherein said securement portion includes an annular flange depending from a lower surface, said flange being adapted for selectively engaging a spring member.

8. The valve stem seal of claim 1, wherein said annular valve body includes an upper portion having an annular groove selectively receiving a ring retainer, said ring retainer selectively compressing said upper portion about said valve stem for enhancing sealability during reciprocal movement of said valve stem.

9. A valve stem assembly comprising:

a valve having an annular valve stem, a valve keeper groove at a first end, and a valve head at a second end;

a valve stem seal having an annular valve body defined by an upper surface and a lower surface, and further including an aperture extending between said upper and lower surface;

an uppermost lip formed from a first angled upper surface and a second angled lower surface, said upper and said lower surfaces both inwardly depending to provide a single surface of said lip in sealing engagement with said stem;

at least one orifice disposed on an inner surface of said uppermost lip between said annular valve body and said valve stem, said orifice adapted to control a rate of oil flow between said annular valve body and said valve stem;

a securement portion beginning below said uppermost lip and extending below a lowermost lip.

10. The valve stem assembly of claim 9, wherein said annular valve body comprises a unitary, molded, elastomeric material.

11. The valve stem assembly of claim 9, wherein said orifice is disposed on said uppermost lip and includes an opening on said upper surface and said lower surface of said lip.

12. The valve stem assembly of claim 9, wherein said annular valve body includes said securement portion securing said valve body from generally moving in an upward and downward direction and an annular flange depending from said lower surface, said flange adapted for selectively engaging a spring member.

13. The valve stem assembly of claim 9, wherein said annular valve body includes an upper portion having an annular groove selectively receiving a ring retainer, said ring retainer being selectively compressing said upper portion about said valve stem for enhancing sealability of said valve stem seal during reciprocal movement of said valve stem.

14. The valve stem assembly of claim 9, wherein a valve keeper selectively engages said valve keeper groove of said valve and a valve retainer.

15. The valve stem assembly of claim 14, wherein said valve retainer is in operational communication with a spring, said spring being disposed between said valve retainer and said annular flange of said valve stem seal.

16. A valve stem seal comprising:

an annular valve body defined by an upper surface and a lower surface, and further including an aperture extending between said upper and lower surface;

an uppermost lip defined by an upper angled lip surface and a lower angled lip surface, said lip being disposed proximate said upper surface, said upper and said lower surfaces both inwardly depending to provide a single surface of said lip in sealing engagement with a valve stem;

at least one orifice disposed through said uppermost lip of said annular valve body between said upper lip surface and said lower lip surface, said orifice adapted to control a rate of oil flow between said annular valve body and said valve stem;

an annular groove disposed substantially directly radially outward from said uppermost lip, said groove being adapted to selectively receive a ring retainer; and a securement portion beginning below said uppermost lip and extending below a lowermost lip.

17. The valve stem seal of claim 16, wherein said annular valve body includes an annular flange depending from said lower surface, said flange being adapted for selectively engaging a spring member.

18. The valve stem seal of claim 16, wherein said orifice includes a generally round, oval, or polygonal shape.

* * * * *